US010219060B2

(12) United States Patent
Koper et al.

(10) Patent No.: US 10,219,060 B2
(45) Date of Patent: Feb. 26, 2019

(54) HELMET-WORN DEVICE FOR ELECTRONIC COMMUNICATIONS DURING HIGH MOTION ACTIVITY

(71) Applicant: Hearshot Inc., Toronto (CA)

(72) Inventors: Sebastian Koper, Toronto (CA); Bart Lipski, Toronto (CA)

(73) Assignee: HEARSHOT INC., Toronto (CA)

( * ) Notice: Subject to any disclaimer, the term of this patent is extended or adjusted under 35 U.S.C. 154(b) by 0 days.

(21) Appl. No.: 15/469,001

(22) Filed: Mar. 24, 2017

(65) Prior Publication Data

US 2017/0280214 A1 Sep. 28, 2017

Related U.S. Application Data

(60) Provisional application No. 62/312,926, filed on Mar. 24, 2016, provisional application No. 62/313,355, filed on Mar. 25, 2016.

(51) Int. Cl.

| | |
|---|---|
| ***H04R 1/02*** | (2006.01) |
| ***A42B 3/30*** | (2006.01) |
| ***H04R 3/00*** | (2006.01) |
| ***H04R 5/02*** | (2006.01) |
| *H04R 17/00* | (2006.01) |
| *H04R 25/00* | (2006.01) |

(52) U.S. Cl.

CPC ..... *H04R 1/028* (2013.01); *A42B 3/30* (2013.01); *A42B 3/306* (2013.01); *H04R 1/026* (2013.01); *H04R 3/00* (2013.01); *H04R 5/02* (2013.01); *H04R 17/00* (2013.01); *H04R 25/606* (2013.01); *H04R 2201/023* (2013.01); *H04R 2420/07* (2013.01)

(58) Field of Classification Search

CPC ..... H04R 1/021; H04R 1/025; H04R 1/026; H04R 1/028; H04R 25/606; H04R 2460/13; A42B 3/30; A42B 3/303; A42B 3/306

See application file for complete search history.

(56) References Cited

U.S. PATENT DOCUMENTS

| | | | | |
|---|---|---|---|---|
| 3,134,861 A * | 5/1964 | Dempsey | ..... | H04R 1/105 381/151 |
| 2009/0122510 A1* | 5/2009 | Stiehl | ..... | H01H 9/0228 361/832 |
| 2015/0063616 A1* | 3/2015 | Westerkull | ..... | H04R 25/00 381/326 |

(Continued)

*Primary Examiner* — Joshua Kaufman
(74) *Attorney, Agent, or Firm* — Dunham IP Law

(57) ABSTRACT

The exemplary embodiments herein provide an assembly for transmitting vibrations to a helmet worn by a user, including an annular element adapted to adhere to an outer surface of the helmet. The exemplary embodiments also include an assembly which rotationally connects with the annular element and comprises a bottom housing having a floor, teeth near the floor which engage with the annular element, and a sidewall extending upwardly around the circumference of the circular base unit. The embodiments further include a top housing having an outer sidewall that fits outside of the sidewall of the bottom housing and a plurality of apertures in a top surface; a pressure transducer placed atop the floor; and a mechanical user interface placed above the PCB and having at least one button which extends upwardly and through one of the apertures on the top surface of the top housing.

19 Claims, 7 Drawing Sheets

(56) References Cited

U.S. PATENT DOCUMENTS

| | | | |
|---|---|---|---|
| 2015/0117688 | A1 | 4/2015 | Kim et al. |
| 2015/0138645 | A1 | 5/2015 | Yoo et al. |
| 2015/0338926 | A1 | 11/2015 | Park et al. |
| 2016/0033772 | A1 | 2/2016 | Han |
| 2016/0088380 | A1 | 3/2016 | Stauber et al. |

* cited by examiner

HELMET-WORN DEVICE FOR ELECTRONIC COMMUNICATIONS DURING HIGH MOTION ACTIVITY

CROSS-REFERENCE TO RELATED APPLICATIONS

This application claims priority to U.S. Provisional Application No. 62/312,926 filed on Mar. 24, 2016, which is herein incorporated by reference in its entirety. This application also claims priority to U.S. Provisional Application No. 62/313,355 filed on Mar. 25, 2016, which is herein incorporated by reference in its entirety.

TECHNICAL FIELD

Embodiments generally relate to helmet-worn devices which can transmit audio from other types of devices by using the user's helmet as a transmission medium for sound pressure waves.

BACKGROUND OF THE ART

During many activities, it is desirable for the participants to be able to effectively and safely listen to audio from other electronic devices such as smartphones. For a number of reasons, including but not limited to the fact that it may be cumbersome to install speakers into the ear covers of existing helmets and that it may be unsafe to wear conventional earbuds or headphones directly over or inside the ears underneath the helmet, existing methods to listen to audio from electronic devices while participating in high motion activities may be ineffective and/or unsafe.

SUMMARY OF THE EXEMPLARY EMBODIMENTS

Exemplary embodiments provide a device for users to listen to streaming audio from electronic devices or communicate with one another while performing high motion activities such as motorcycle riding, skiing/snowboarding, kiteboarding, wakeboarding, cycling, jet skiing, snowmobiling, cross-country skiing, construction/contractor activities, search and rescue activities, and other similar activities. A significant proportion of these activities are performed while the user is wearing a helmet. A helmet or hardhat is typically constructed of a hard outer plastic shell with rigid foam padding inside. It has been discovered that the rigidity of the helmet construction, even though there is a large amount of variability between types of helmets, provides a medium through which sound pressure waves may be transmitted.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
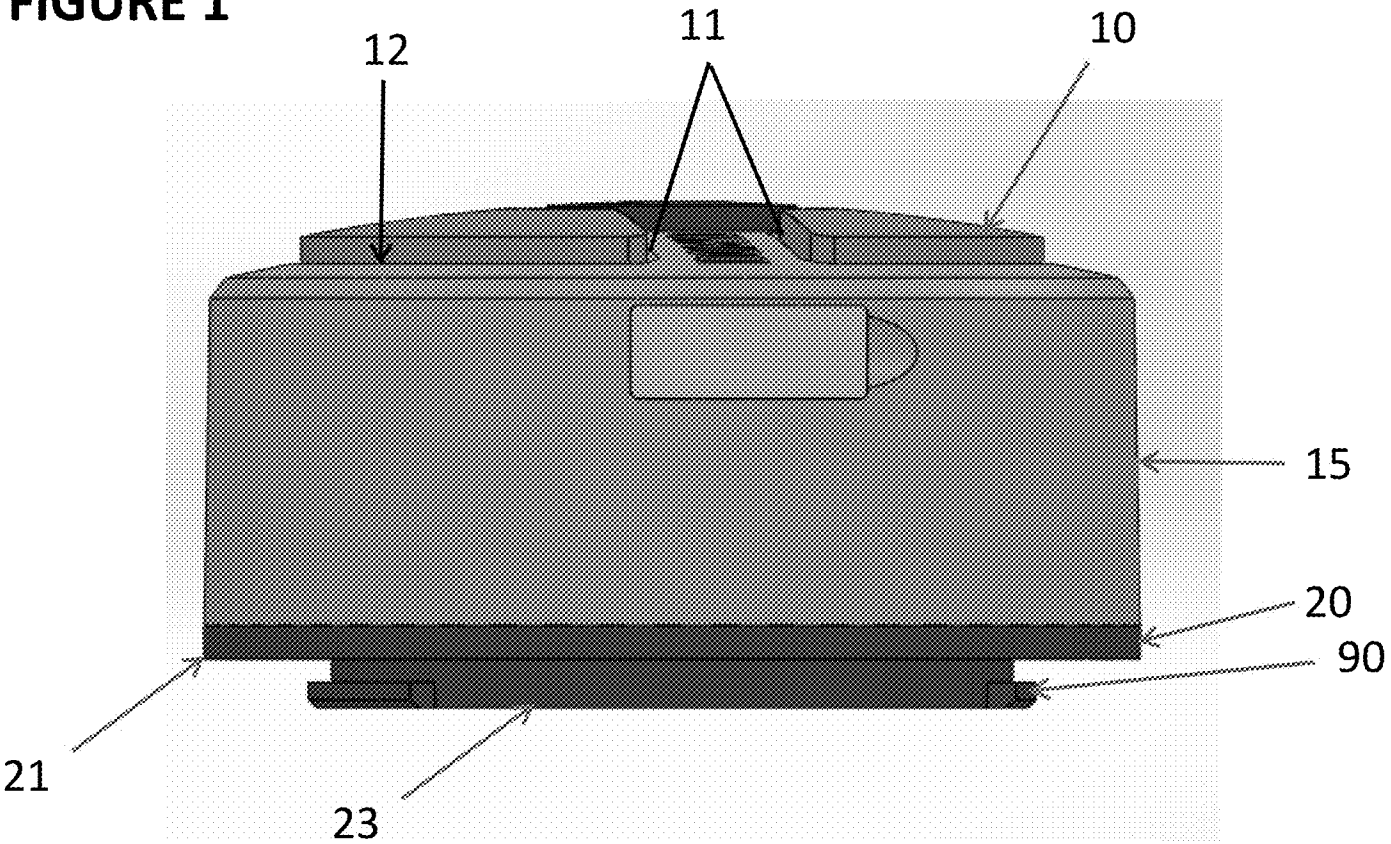
FIG. 1 is a side elevation view of an exemplary embodiment of the device.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term 'helmet' applies to any rigid device that is worn on the head for protection against impact and would specifically include construction hard hats.

FIG. 1 is a side elevation view of an exemplary embodiment of the device. A top housing 15 may be provided which includes an inverted cup-shaped housing with an open interior cavity, bottom opening, and one or more apertures 11 in the top surface 12. A housing base 20 connects to the bottom opening of the top housing 15, is generally annular in shape with a sidewall extending upwardly from an upper annular element 21. One or more teeth 90 preferably extend radially from a lower annular element 23. A mechanical user interface 10 extends upwardly, with portions passing through the apertures 11 in the top surface 12 of the top housing 15, extending above the top surface 12 of the top housing.

Figure 2:
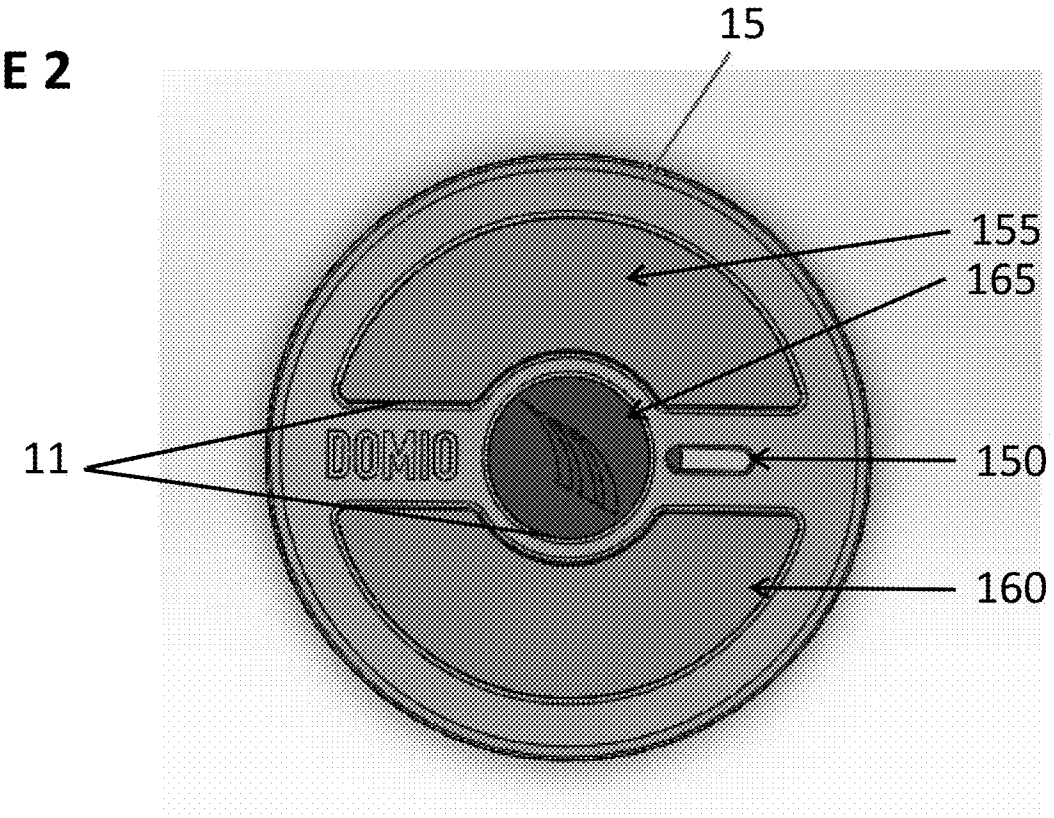
FIG. 2 is a top plan view of the exemplary embodiment of the device shown in FIG. 1.

FIG. 2 is a top plan view of the exemplary embodiment of the device shown in FIG. 1. From this view, one can see the volume up button 155, main activation button 165, LED status indicator 150, and volume down button 160. Of course, any person of ordinary skill in the art could utilize any button for any purpose, and these are only suggestions for an exemplary embodiment. The buttons 155, 165, and 160 form part of the mechanical user interface 10 and extend upwardly from a base plate (shown below). Preferably, the mechanical user interface 10 is comprised of a flexible material, preferably an elastomer or rubber. As the base plate of the mechanical user interface 10 is pressed against the bottom interior surface (opposing the top surface 12) of the top housing 15, the mechanical user interface 10 may be compressed against the surface to provide a seal between the buttons 155, 165, and 160 with the apertures 11 in the top housing 15.

The LED status indicator 150 may be visibly positioned under an aperture in the top housing 15 to preferably indicate to the user the operating state of the device as well as the battery level. The LED is preferably an RGB-type and is oval in shape to allow illumination of four discrete lights to represent various states and levels. In some embodiments, the LED status indicator 150 may be circular in shape with one, multi-colored LED light representing various states and levels. The volume up button 155 allows the user to elevate the volume level of the audio. Similarly, the volume down button 160 allows the user to lower the volume level of the audio. Both buttons may be slightly concave in profile to provide guidance for the user when the device is in operation and is not in the user's line of sight. The main activation button 165 enables the user to power on/off the device as well as temporarily disable and re-enable from/to group communications. The main activation button 165 should preferably have a relatively large surface area among the three as the larger size easily allows the user to disable when sudden conditions may arise that require the user to be more attentive to their environment.

Figure 3:
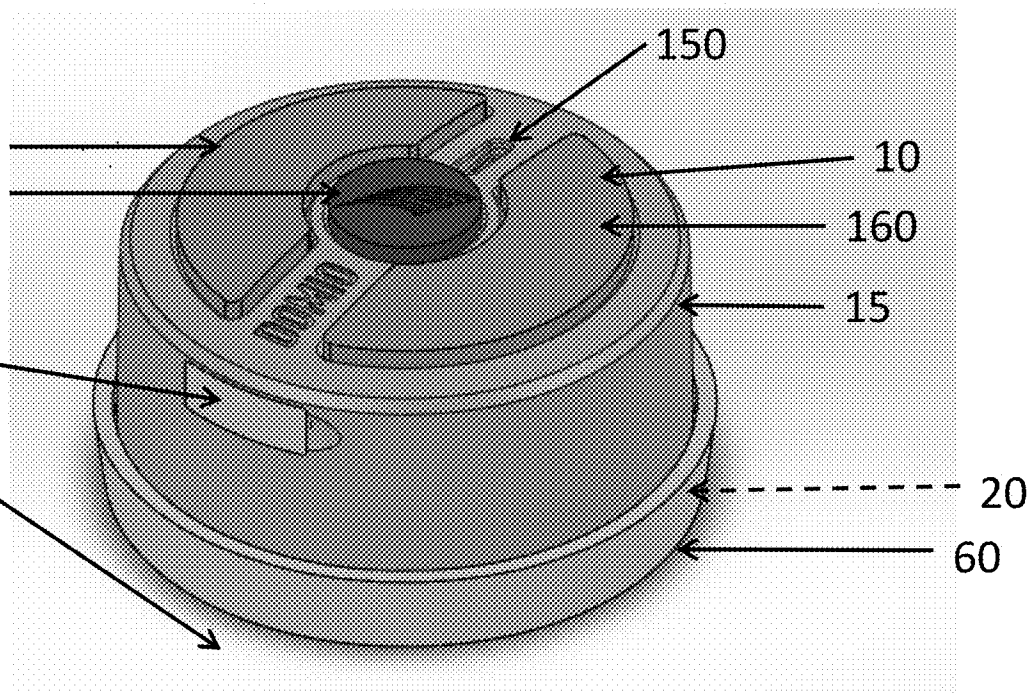
FIG. 3 is a perspective view of an exemplary embodiment of the device, shown connected with the helmet mating mount 60.

FIG. 3 is a perspective view of an exemplary embodiment of the device, shown connected with the helmet mating mount 60. As shown, the helmet mating mount 60 is also generally described as an annular element which attaches to the outer surface of the helmet 500. When the device is in use (worn by the user), the helmet mating mount 60 provides a means to mechanically secure the device to the helmet by rotationally securing to the annular attachment ring 90 at the bottom of the device. The helmet mating mount 60 preferably contains an outer wall about 3 mm in thickness and height. In some embodiments, the wall separately may contain or may be constructed from an open cell insulation foam. An access panel 200 provides access to the interior of the top housing 15, specifically for charging the battery or syncing a transmitter for data transmission to the device.

Figure 4:
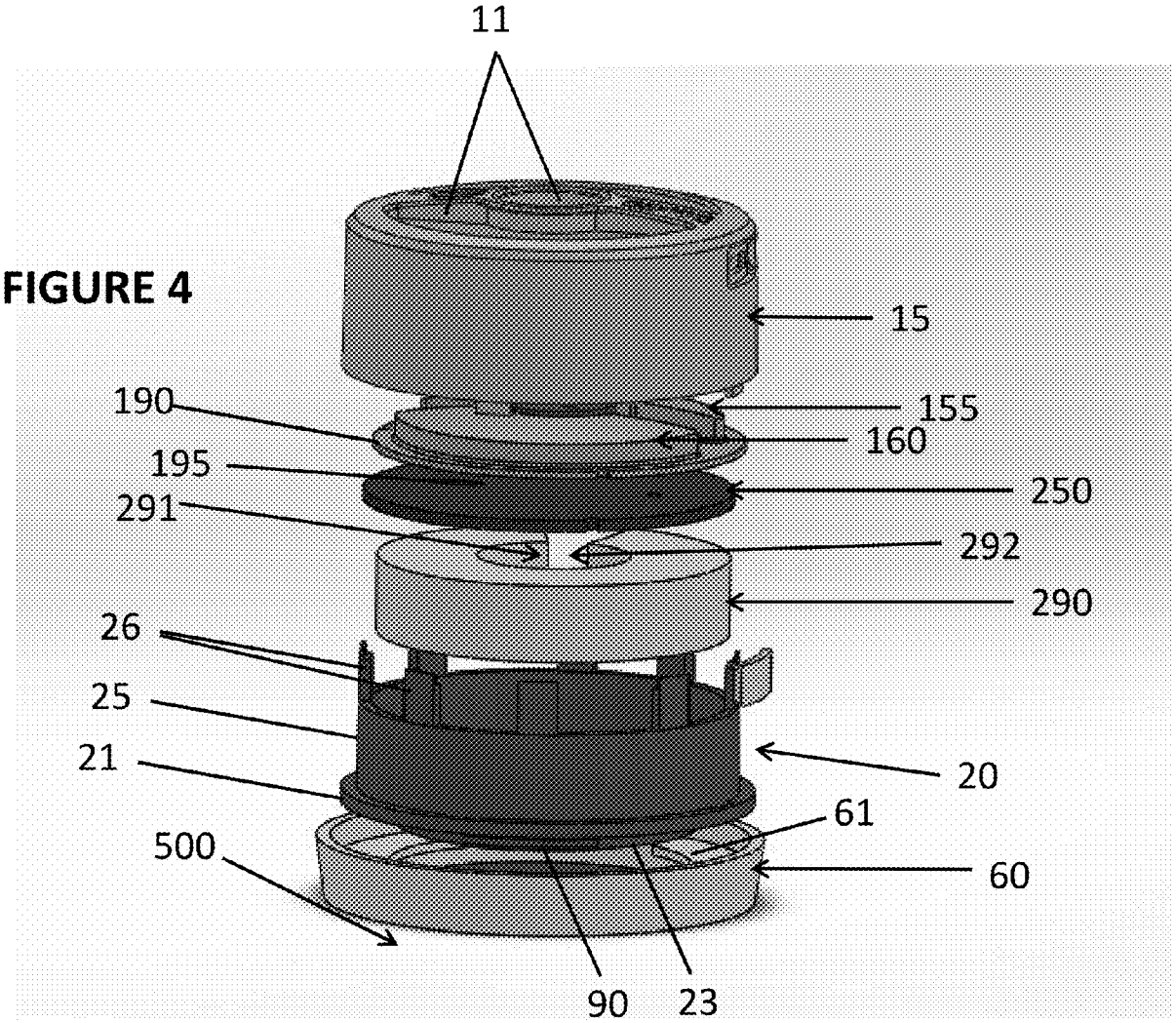
FIG. 4 is an exploded component view of an exemplary embodiment of the device.

FIG. 4 is an exploded component view of an exemplary embodiment of the device. The components are preferably assembled co-axially in a vertical stack-up. In this view, the foam insulator 290 is seen in the middle of the vertical assembly. The foam insulator is preferably constructed from a rigid, open-cell foam preferably with a sound absorption coefficient of 0.5 or higher. The foam insulator 290 is generally an annular element with an opening 291 in the center for accepting the pressure transducer (shown below) as well as an optional cutout portion 292. The housing base 20 is generally annular in shape with a sidewall 25 extending upwardly from an upper annular element 21. A plurality of tabs 26 preferably extend upwardly from the top of the sidewall 25 to engage with accepting apertures in the top housing 15. One or more teeth 90 preferably extend radially from a lower annular element 23.

As mentioned above, the buttons 155, 165, and 160 form part of the mechanical user interface 10 and extend upwardly from a base plate 190. When assembled, the base plate 190 of the mechanical user interface 10 should rest atop the PCB 250. A switch 195 may be placed on the PCB 250 and beneath each button 155, 165, and 160 so that when the button is pressed by the user, the interface 10 will stroke downwardly until contacting the switch 195, allowing the user to control the device.

When installing the housing base 20 on to the helmet mating mount 60, the teeth 90 of the housing base 20 should slide underneath one or more ledges 61 in the mating mount 60. As the housing base 20 is rotated and the teeth 90 engage with the ledge 61, a compressive force of 5-10 Newtons is preferably applied from the floor 24 of the bottom housing 20 onto the helmet 500. Once installed, the top ring 21 should contact the top surface of the ledges 61. This can be provided by placing the teeth 90 at a downward angle relative to horizontal, preferably about 10 degrees below the horizontal median. There should be direct contact between the bottom ring 23 and the helmet 500, as such direct contact between the two surfaces allows for vibrational sound to efficiently transmit from the device to the helmet.

Figure 5:
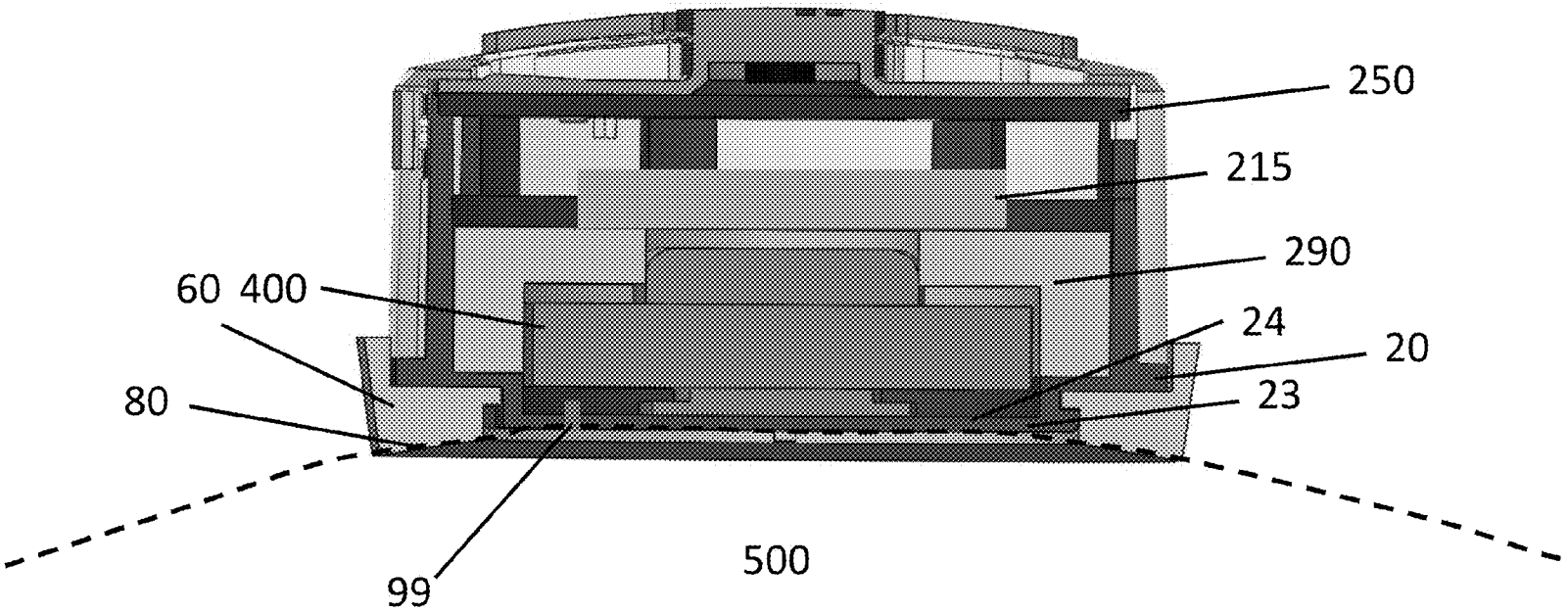
FIG. 5 is a section view taken from a vertical cutting plane that passes through the central axis of the device.

FIG. 5 is a section view taken from a vertical cutting plane that passes through the central axis of the device. The helmet mating mount 60 has a curvature to the bottom surface which generally aligns with the curvature of helmets, along with a layer of adhesive 80 (preferably double-sided) for attaching the mount 60 to the surface of the helmet 500. The bottom housing 20 contains a floor 24, which provides the bottom to the cup-like shape of the bottom housing 20. The pressure transducer 400 preferably sits atop the floor 24, and preferably directly atop the floor 24. As shown, the floor 24 is also preferably in direct contact with the helmet 500. The helmet 500, which is generally comprised of a rigid, solid shell often constructed of a stiff polymer, then resonates the vibrational sound within, allowing the user to hear the transmitted audio with no need for traditional speakers or ear buds of any kind. The pressure transducer 400 is preferably a planar wave vibration exciter.

Due to the curvature of the bottom surface of the helmet mating mount 60, the bottom surface of the floor 24 sits vertically above the lowest point on the helmet mating mount 60. As described below, the pressure transducer 400 is in electrical connection with the PCB 250. Although axially-surrounded by the foam insulator 290, it is preferable that the pressure transducer 400 is not in contact with the foam 290, but is only in contact with the floor 24. A battery 215 is preferably placed atop the foam 290, covering the central opening 291. The cutout 292 may be used for routing the wiring from the pressure transducer 400 to the PCB 250, avoiding the battery 215 while maintaining the maximum volume of foam 290.

The floor 24 of the bottom housing 20 should preferably be comprised of a material that meets a number of design requirements. It should preferably have an acoustic impedance value of approximately 2.5 which is consistent with the acoustic impedance of the materials of the outer shells of a majority of sports helmets and construction hats. This matching will minimize the degree of sound waves reflected and refracted at the interface of the floor 24 and the helmet 500 during sound transmission. It should preferably have a flexural modulus value of between 25,000 psi and 35,000 psi to allow the floor 24 to bend slightly and conform to the curve of the helmet 500. In some embodiments, the lower part of the bottom housing 20 or the entire bottom housing 20 may be entirely comprised of this material. In alternative embodiments, the floor 24 alone may be comprised of this material while the remainder of the bottom housing 20 is comprised of another polymer material. In some embodiments, the floor 24 is perforated with a series of 10-20 small through holes with a diameter of approximately 1 mm. In alternate embodiments, the floor 24 contains a series of 10-15 small metal rods 99 each with a diameter of approximately 1 mm inserted through the floor 24.

In some embodiments, a bender piezoelectric configuration is used as an alternative to the pressure transducer 70 and the floor 24.

Figure 6:
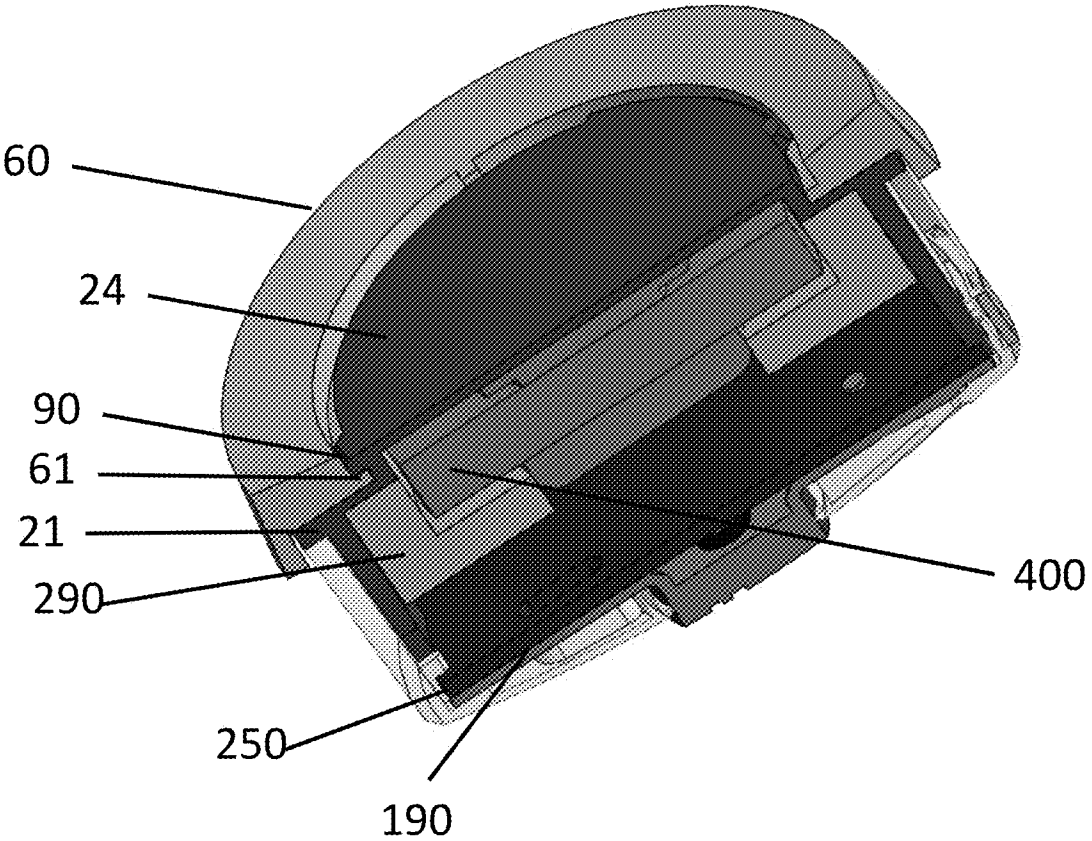
FIG. 6 is a bottom perspective view of the section view that is shown above in FIG. 5.

FIG. 6 is a bottom perspective view of the section view that is shown above in FIG. 5. Here, the curvature of the bottom surface of the mating mount 60 can be observed along with the underside of the floor 24, which is generally planar (at least prior to being assembled with the helmet mating mount 60) and as noted above, contacts at least a portion of the helmet 500 in order to properly transmit pressure transducer frequencies. However, as described herein, the floor 24 (and other portions of the bottom housing 20) may be comprised of a flexible material, so that as the bottom housing 20 engages with the helmet mating mount 60, the floor 24 is deformed slightly, to change from a substantially planar shape to one with a curvature that matches the curvature of the outer surface of the helmet 500.

Figure 7:
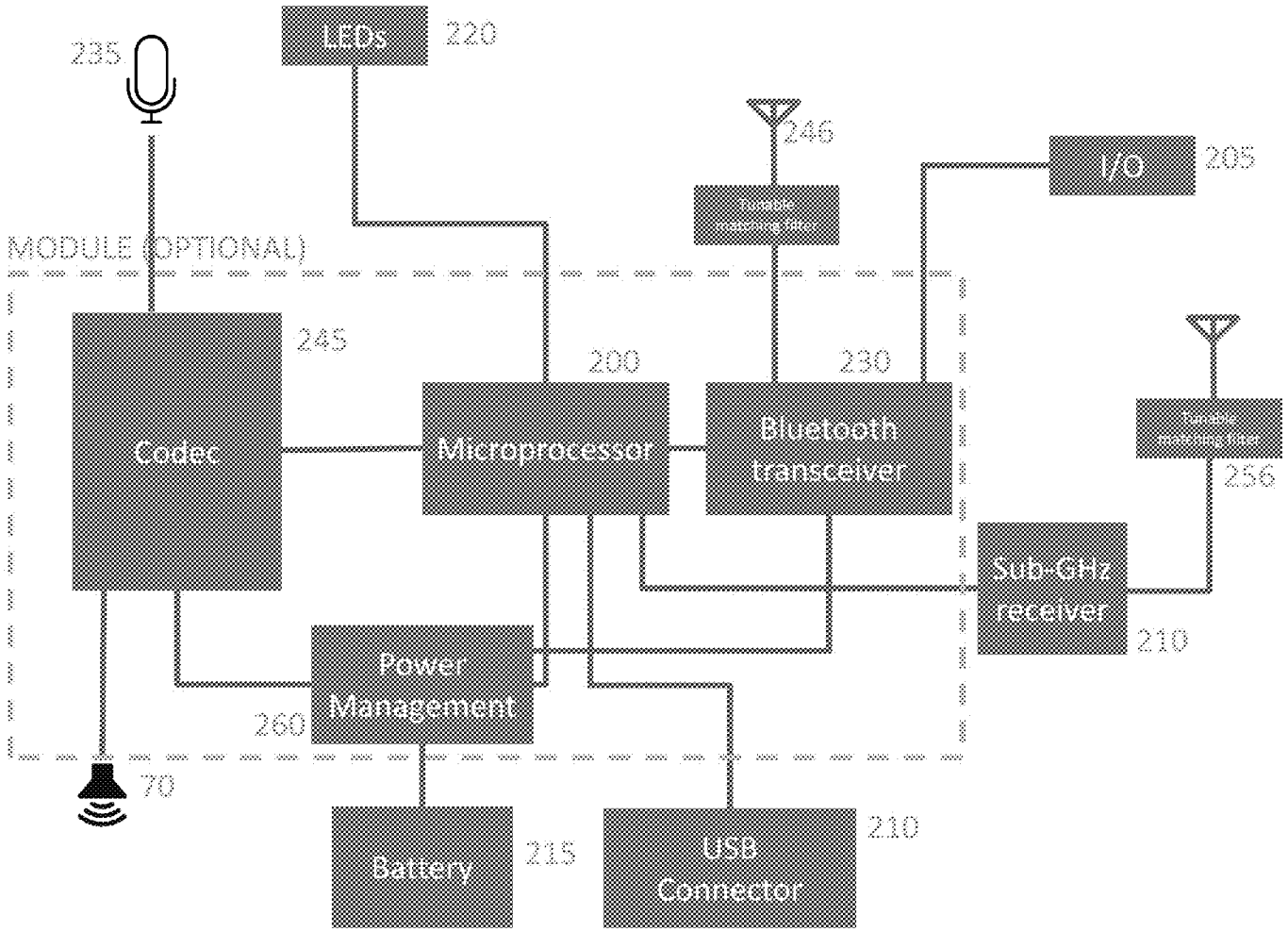
FIG. 7 is an electrical block diagram showing several components which may be contained within the top housing 15.

FIG. 7 is an electrical block diagram showing several components which may be contained within the top housing 15. These components include but are not limited to: a RF transceiver 230, microprocessor 200, sub-GHz RF receiver 210, push button interface, battery 215, power management 260, audio codec 245, indicator LEDs 220, Bluetooth antenna 246, USB connector 210, and sub-GHz RF antenna 256. In some embodiments, some of these components may be contained within an integrated module. The wireless transceiver 230 is preferably a Bluetooth streaming module which allows a user to stream audio from a Bluetooth device. While Bluetooth has been suggested here, it is well known that other types of wireless pairing standards could be used as well, and thus any type of wireless pairing could be used, Bluetooth is simply preferable.

The first microphone 235 allows the user to send spoken audio, captured by the first microphone 235, back out to a smart device using the wireless streaming module 210. This would allow a user to take phone calls or send voice instructions to a smart device. A second microphone (not shown) may be used in order to perform a noise cancellation algorithm. In this embodiment, voice frequencies along with some ambient noise will be captured by the first microphone 235 while the second microphone captures mostly ambient noise but with some voice frequencies as well. The two input waves are then shifted by 180 degrees in phase in order to create destructive interference. This preferably causes the ambient noise to be subtracted from the voice and ambient noise signal of the first microphone 235.

In some embodiments, a modular, wireless microphone is used as a means of enable two-way communications with the phone connected by Bluetooth. The modular microphone is preferably connected by sub-GHz radio frequency to the main device.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

The invention claimed is:

1. An assembly for transmitting vibrations to a helmet worn by a user, the device comprising:
- an element adapted to adhere to an outer surface of the helmet;
- an assembly which connects with the element and comprises
  - a bottom housing having a floor which passes through the element, teeth near the floor which engage with the element, and a sidewall extending upwardly around the perimeter of the bottom housing;
  - a top housing having an outer sidewall that fits outside of the sidewall of the bottom housing and also having a plurality of apertures in a top surface;
  - a PCB which sits within the top housing,
  - a pressure transducer placed atop the floor and in electrical connection with the PCB; and
  - a mechanical user interface placed above the PCB and having at least one button which extends upwardly and through one of the apertures on the top surface of the top housing.

2. The assembly of claim 1 further comprising:
- a foam element placed inside the sidewall of the bottom housing and beneath the PCB.

3. The assembly of claim 1 further comprising:
- a switch placed on the PCB and located beneath the button on the mechanical user interface.

4. The assembly of claim 1 further comprising:
- a foam element which surrounds the pressure transducer.

5. The assembly of claim 4 wherein:
- the foam element does not contact the pressure transducer.

6. An assembly for transmitting vibrations to a helmet worn by a user, the device comprising:
- an element having a bottom surface with a curvature that conforms to the curvature of an outer surface of the helmet;
- an assembly which connects with the annular element and comprises
  - a bottom housing having a floor which contacts the helmet when the bottom housing engages with the element;
  - a top housing having an outer sidewall that fits outside the bottom housing;
  - a PCB which sits within the top housing,
  - a pressure transducer placed above the floor and in electrical connection with the PCB;
  - a foam element surrounding a portion of the pressure transducer and having a central hole; and
  - a battery placed atop the foam element and covering the central hole.

7. The assembly of claim 6 wherein:
- the teeth of the bottom housing engage with the annular element by sliding underneath one or more ledges in the element.

8. The assembly of claim 7 wherein:

a compressive force of 5-10 Newtons is preferably applied from the floor of the bottom housing onto the helmet, once the bottom housing has been fully engaged with the element.

9. The assembly of claim 6 wherein:

the bottom housing passes through the element.

10. An assembly for transmitting vibrations to a helmet worn by a user, the device comprising:

a mount adapted to adhere to an outer surface of the helmet, and having one or more ledges which extend inward from an interior wall of the mount;

an assembly which connects with the annular element and comprises a bottom housing having a floor and teeth near the floor which slide beneath the ledges such that the floor contacts the outer surface of the helmet once the bottom housing is fully engaged with the mount;

a top housing having an outer sidewall that fits outside the bottom housing;

a PCB which sits within the top housing, a pressure transducer placed in the bottom housing and in electrical connection with the PCB;

and a battery placed above the pressure transducer.

11. The assembly of claim 10 further comprising:

one or more metallic elements which pass through the floor.

12. The assembly of claim 10 further comprising:

a mechanical user interface having a plate which rests atop the PCT and one or more buttons which extend upwardly from the plate.

13. The assembly of claim 12 wherein:

each button passes through an aperture in the top housing, extending above a top surface of the top housing.

14. The assembly of claim 12 wherein:

each button creates a water seal where the button contacts the aperture.

15. The assembly of claim 12 wherein:

the floor is not substantially planar the once the bottom housing is fully engaged with the mount.

16. The assembly of claim 10 further comprising:

a ring that extends around a periphery of the bottom housing and contains a bottom surface that is substantially planar.

17. The assembly of claim 16 wherein:

the bottom surface of the ring rests atop the ledges once the bottom housing is fully engaged with the mount.

18. The assembly of claim 10 wherein:

the bottom housing passes through the mount.

19. The assembly of claim 10 wherein:

the top housing, bottom housing and mount have substantially similar footprints to one another.

* * * * *